US005646631A

United States Patent [19]

Arntz

[11] Patent Number: 5,646,631

[45] Date of Patent: Jul. 8, 1997

[54] PEAK POWER REDUCTION IN POWER SHARING AMPLIFIER NETWORKS

[75] Inventor: Bernard James Arntz, Morristown, N.J.

[73] Assignee: Lucent Technologies Inc., Murray Hill, N.J.

[21] Appl. No.: 573,619

[22] Filed: Dec. 15, 1995

[51] Int. Cl.[6] ..... H01Q 3/22; H01Q 3/24

[52] U.S. Cl. ..... 342/373; 342/374

[58] Field of Search ..... 342/373, 374; 455/126, 115, 116

[56] References Cited

U.S. PATENT DOCUMENTS

| | | | |
|---|---|---|---|
| 3,480,885 | 11/1969 | Schrank . | |
| 3,731,217 | 5/1973 | Gerst et al. . | |
| 3,917,998 | 11/1975 | Welti . | |
| 4,107,688 | 8/1978 | Alford | 343/108 R |
| 4,901,085 | 2/1990 | Spring et al. | 342/373 |
| 4,907,004 | 3/1990 | Zacharatos et al. . | |
| 4,965,587 | 10/1990 | Lenormand et al. . | |
| 5,093,668 | 3/1992 | Sreenivas . | |
| 5,105,170 | 4/1992 | Joshi . | |
| 5,115,248 | 5/1992 | Roederer . | |
| 5,119,042 | 6/1992 | Crampton et al. . | |
| 5,289,193 | 2/1994 | Lenormand et al. | 342/374 |
| 5,414,433 | 5/1995 | Chang . | |
| 5,526,528 | 6/1996 | Kurisu | 455/117 |

FOREIGN PATENT DOCUMENTS

355979A2 2/1990 European Pat. Off. .

OTHER PUBLICATIONS

W. A. Sandrin, "The Butler Matrix Transponder", Comsat Technical Review, vol. 4, No. 2, Fall 1974.

W. R. Bennet, "Distribution of the Sum of Randomly Phased Components", Quarterly Applied Mathematics, 5, No. 4, Jan. 1948, pp. 385–393.

M. Slack, "The Probability Distributions of Sinusoidal Oscillations Combined in Random Phase", J.I.E.E., 93, 1946, pp. 76–86.

*Primary Examiner*—Thomas H. Tarcza
*Assistant Examiner*—Dao L. Phan

[57] ABSTRACT

In a preferred embodiment, an apparatus for amplifying a plurality of input signals is provided, including a power sharing amplifier network and a redistribution circuit. The power sharing amplifier network includes first and second distributing networks and a plurality of amplifiers coupled therebetween. Each amplifier amplifies a composite signal having an approximately equal amount of signal power from all of the input signals. The first distributing network receives and splits up the input signals, whereas the second distributing network receives and recombines the amplified signals from the amplifiers to provide amplified output signals, each corresponding to one of the input signals. The redistributing circuit provides a redistribution signal derived from the input signals, which is applied to the first distributing network. The amplitude and phase characteristics of the redistribution signal are such that when it is split up by the first distributing network, it vectorially combines with the composite signals so as to reduce peak envelope power within at least one composite signal.

21 Claims, 10 Drawing Sheets

PEAK POWER REDUCTION IN POWER SHARING AMPLIFIER NETWORKS

FIELD OF THE INVENTION

The present invention relates generally to amplifier networks, and more particularly, to a power sharing amplifier network employing a peak power reduction technique, which is useful in wireless telecommunications.

BACKGROUND OF THE INVENTION

Wireless telecommunications systems of the prior art typically employ a separate high power radio frequency (RF) amplifier to excite each transmitting antenna used at the base station. Typically, each power amplifier amplifies modulated RF signals of a plurality of frequency channels for transmission to mobile users and/or to stationary sites. Multi-sector systems employ a plurality of directional antennas to provide directional beams over predefined azimuthal sectors, thereby attaining 360 degree coverage with improved range. Each power amplifier associated with a given antenna is thus dedicated to amplifying only those signals to be transmitted within the associated azimuthal sector.

FIG. 1 depicts a schematic block diagram of a prior art base station transmitter configuration for a three sector system. Antennas $AT_1$–$AT_3$ each transceive within a given 120° azimuthal sector to achieve 360° coverage within a given radius of the base station. Power amplifiers $P_1$–$P_3$ each amplify a respective multiplexer signal $S_{MUX1}$–$S_{MUX3}$, which are typically frequency division multiplexed (FDM) signals. N-channel combiners $CN_1$–$CN_3$ each combine up to N input signals to provide the multiplexed signals. Power amplifiers $P_1$–$P_3$ are generally sized so as to handle a peak traffic load that is based on statistics or on the maximum number of radios in its associated sector, since traffic load fluctuates minute by minute.

When a large number of users are communicating from a single azimuthal sector, the power amplifier $P_1$–$P_3$ associated with that sector is fully utilized, while the other power amplifiers, which service other azimuthal sectors, may be under-utilized. Accordingly, RF power is not efficiently distributed in the system of FIG. 1. One solution to this inefficient power distribution is described in my copending U.S. patent application Ser. No. 08/542,480, filed Oct. 13, 1995, and assigned to the assignee herein. Therein, a power sharing amplifier network is described, which includes a plurality of amplifiers in a power sharing arrangement, such that each amplifier amplifies an approximately equal amount of RF power. Each amplifier in the network amplifies a composite signal containing signal power from all the communication signals to be transmitted by the system. In this manner, average power is efficiently shared between the amplifiers, such that the system can accommodate a larger number of subscribers. Further, feed-forward loops are employed to reduce distortion within the output signals.

While the amplifiers in the amplifier network described in the above-cited patent application share average RF power, instantaneous peak power differs between the amplifiers due to the varying phase relationships between the multi-carrier components of the signals applied to the amplifiers. Due to the random phase of the input signals, peak power can periodically peak to undesirable extremes in any given amplifier. The amplifiers must therefore be designed to handle such peak power, resulting in an increase in amplifier cost and complexity. Accordingly, there is a need to reduce instantaneous peak power applied to the amplifiers of a power sharing amplifier network.

SUMMARY OF THE INVENTION

Embodiments of the present invention can reduce peak envelope power within amplifiers of a power sharing amplifier network. In a preferred embodiment of the invention, an apparatus for amplifying a plurality of input signals is provided, including a power sharing amplifier network and a redistribution circuit. The power sharing amplifier network includes first and second distributing networks and a plurality of amplifiers coupled therebetween. Each amplifier amplifies a composite signal having an approximately equal amount of signal power from all of the input signals. The first distributing network receives and splits up the input signals, whereas the second distributing network receives and recombines the amplified signals from the amplifiers to provide amplified output signals, each corresponding to one of the input signals. The redistributing circuit provides a redistribution signal derived from the input signals, which is applied to the first distributing network. The amplitude and phase characteristics of the redistribution signal are such that when it is split up by the first distributing network, it vectorially combines with the composite signals so as to reduce peak envelope power within at least one composite signal.

Preferably, the redistribution circuit receives coupled portions of the input signals and includes a third distributing network substantially identical to the first distributing network. The third distributing network provides a set of second composite signals, which are detected by peak detectors. Time varying voltages provided by the peak detectors are supplied to a decision circuit that determines which one of the second composite signals is of the highest peak power. The decision circuit then controls a switch to route signal power from that second composite signal towards the first distribution network. In this fashion, the redistribution signal thus comprises substantially the second composite signal with the highest peak power at any given time. With appropriate phase shifting, the redistribution signal then reduces peak power within the composite signal of the amplifier network having the highest peak power at any given time.

BRIEF DESCRIPTION OF THE DRAWINGS

For a full understanding of the present invention, reference is had to exemplary embodiments thereof, considered in conjunction with the accompanying drawings in which like reference numerals depict like elements or features, wherein.

DETAILED DESCRIPTION OF THE PREFERRED EMBODIMENTS

Figure 2:
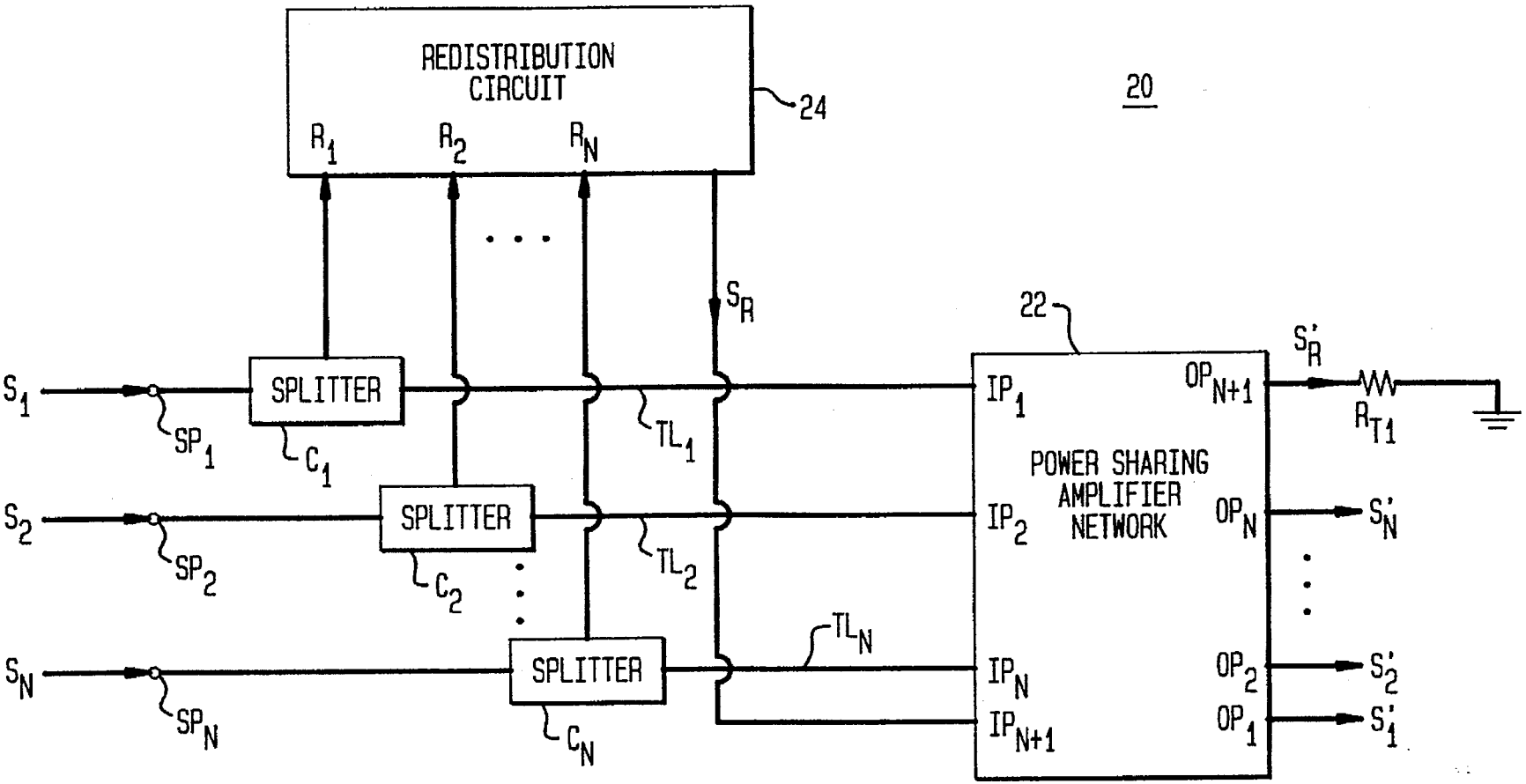
FIG. 2 is a schematic block diagram of an embodiment of an amplification system in accordance with the present invention.

FIG. 2 shows a schematic block diagram of an embodiment of an amplification system in accordance with the present invention, designated generally as 20. System 20 functions to linearly amplify a plurality N of input signals $S_1$–$S_N$ to provide a corresponding plurality of amplified output signals $S_1'$–$S_N'$. Each input signal $S_1$–$S_N$ may be an RF modulated, multicarrier signal, such as an FDM signal.

System 20 includes power sharing amplifier network 22, redistribution circuit 24, and power splitters $C_1$–$C_N$ coupled between corresponding input ports $IP_1$–$IP_N$ of network 22 and input ports $R_1$–$R_N$ of circuit 24. Amplifier network 22 functions to linearly amplify RF signals that appear at respective input ports $IP_1$–$IP_{N+1}$. Amplifier network 22 employs a plurality of amplifiers (not shown in FIG. 2) configured in a power sharing arrangement, such that each amplifier in the network amplifies a composite signal having substantially equal amount of signal power from all of signals $S_1$–$S_N$. Each composite signal also includes power from a redistributing signal $S_R$ generated by redistribution circuit 24 and applied to input port $IP_{N+1}$. The amplified composite signals then recombine within network 22 such that amplified signals $S_1'$–$S_N'$ appear on respective output ports $OP_1$–$OP_N$, and the amplified redistribution signal appears on port $OP_{N+1}$, where it is terminated by resistor $R_{T1}$. Detailed exemplary configurations for network 22 will be discussed below.

Redistribution circuit 24 functions to provide signal $S_R$ at an appropriate amplitude and phase so as to reduce instantaneous peak RF power incident upon the amplifier in network 22 with the highest incident peak power at any given time.

Figure 3:
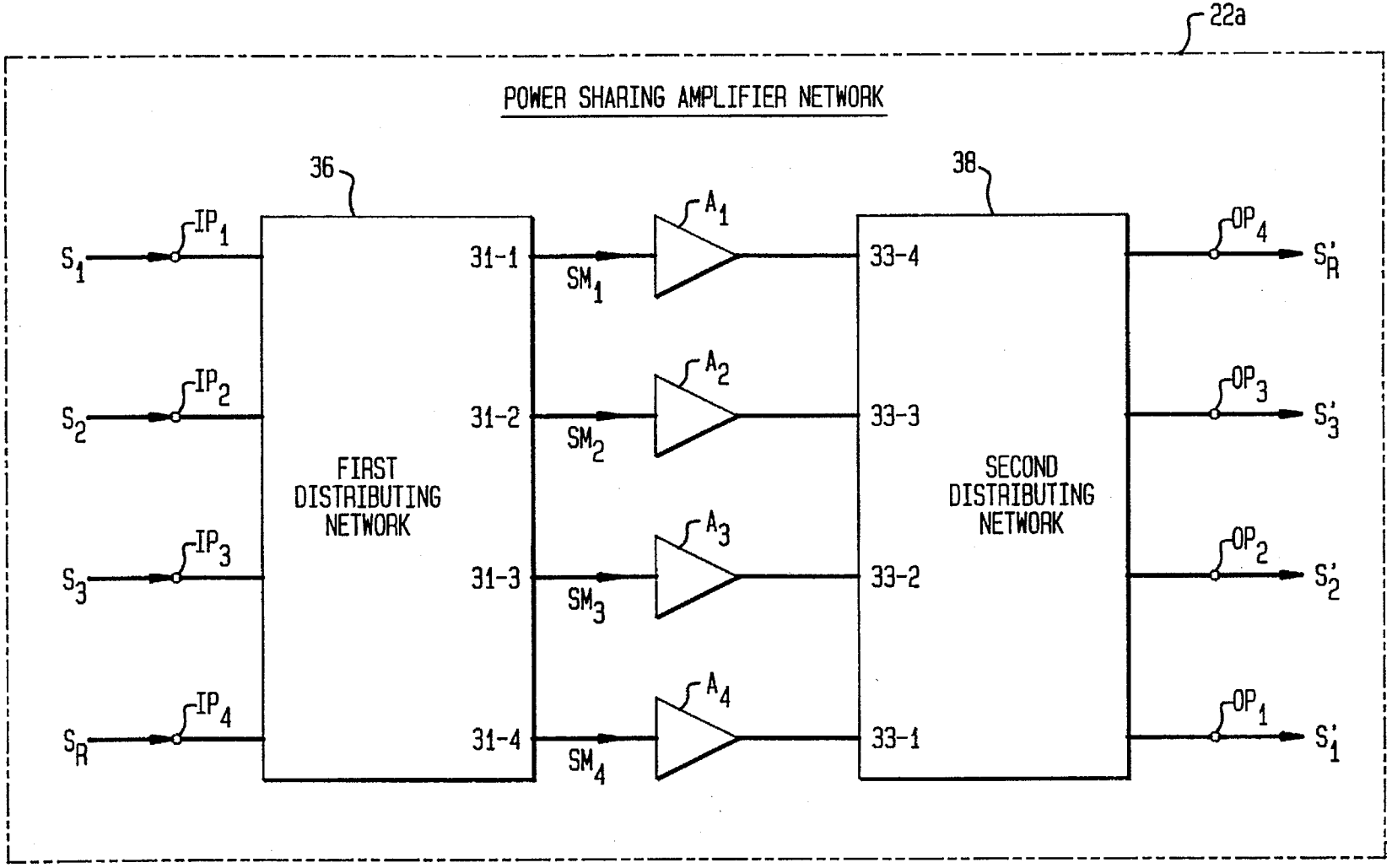
FIG. 3 shows a schematic block diagram of a power sharing amplifier network, which may be used within the system of FIG. 2.

FIG. 3 shows a schematic block diagram of an exemplary power sharing amplifier network **22*a*, which is an embodiment of amplifier network 22 of FIG. 2. For illustrative purposes, amplifier network 22*a* will be described as one which amplifies each of input signals $S_1$–$S_3$ and signal $S_R$. Thus, in the exemplary case, N equals three. It is understood, however, that more or fewer input signals can be amplified by analogous versions of network 22*a***, as will be explained below.

First distributing network 36 receives input signals $S_1$–$S_3$ at respective first input ports $IP_1$–$IP_3$, and signal $S_R$ at input port $IP_4$. (It is noted that signals $S_1$–$S_3$ shown in FIG. 3 are attenuated versions of corresponding input signals shown in FIG. 2, due to transmission loss through splitters $C_1$–$C_3$). First distributing network 36 divides signal power from each of signals $S_1$–$S_3$ and $S_R$ among first output ports 31-1 to 31-4, to produce respective composite signals $SM_1$–$SM_4$ thereon. Each composite signal $SM_1$–$SM_4$ is thus comprised of signal power of all input signals $S_1$, $S_2$, $S_3$ and $S_R$. Preferably, each input signal is divided equally among output ports 31-1 to 31-4. This way, composite signals $SM_1$–$SM_4$ have substantially equal average power, even if signals $S_1$–$S_3$ and $S_R$ vary widely in power. Thus, in the present example, each composite signal $SM_1$–$SM_4$ will contain approximately ¼ of the signal power of each input signal $S_1$–$S_3$ and $S_R$.

Composite signals $SM_1$–$SM_4$ are applied to respective power amplifiers $A_1$–$A_4$, which preferably have substantially identical performance specifications, such as gain, insertion phase, output power, gain versus frequency and temperature, operating bias voltages, and so on. Amplifiers $A_1$–$A_4$ are, in practice, not perfectly linear, and will typically produce a finite amount of IMD products when signals $SM_1$–$SM_4$ contain multiple carriers. For randomly changing input phase conditions, composite signals $SM_1$–$SM_4$ are substantially equal in average power when averaged over many envelope cycles. Thus, amplifiers $A_1$–$A_4$ each typically provide the same mount of average output power at any given time. Hence, even if input signals $S_1$–$S_3$ vary in power, no single amplifier will be driven further into saturation than the others. However, without redistribution signal $S_R$, peak instantaneous RF power applied to each amplifier $A_1$–$A_4$ varies considerably with time. As will be explained further below, the application of signal $S_R$ results in a reduction of the highest peak power level applied to any one of the amplifiers, thereby reducing the peak to average power ratio of the amplifiers.

By way of example, in a wireless telecommunication system, input signals $S_1$–$S_3$ can be multi-carrier signals at UHF or microwave frequencies, each carrying communication signals intended for wireless terminals within a given angular sector. In this case, when communication traffic is distributed unequally among the angular sectors, amplifiers $A_1$–$A_4$ will nevertheless amplify substantially the same amount of signal power. This aspect of the invention provides a marked advantage over the prior art systems discussed above. A corresponding decrease in hardware needed at each base station may be realized as a natural consequence of such a power-sharing arrangement while keeping the same blocking rate. A major benefit of such power sharing is that power may be shared to realize a reduction in the total power requirements at the base station. For instance, power may be diverted to one sector when the input is driven by a large number of radios. This power may be added to the sector by means of switching in more radios. Alternatively, the power of a given radio or group of radios on one sector could be increased during times when power from the other sectors was available.

The amplified composite signals provided by amplifiers $A_1$–$A_4$ are applied to second input ports 33-4 to 33-1, respectively, of second distributing network 38. Network 38 recombines the amplified composite signals to provide amplified, reconstructed output signals $S_1'$,$S_2'$,$S_3'$ and $S_R'$ at second output ports $OP_1$–$OP_4$, respectively. Each output signal $S_1'$–$S_3'$ and $S_R'$ is thus an amplified version of corresponding input signals $S_1$–$S_3$ and $S_R$.

Figure 4:
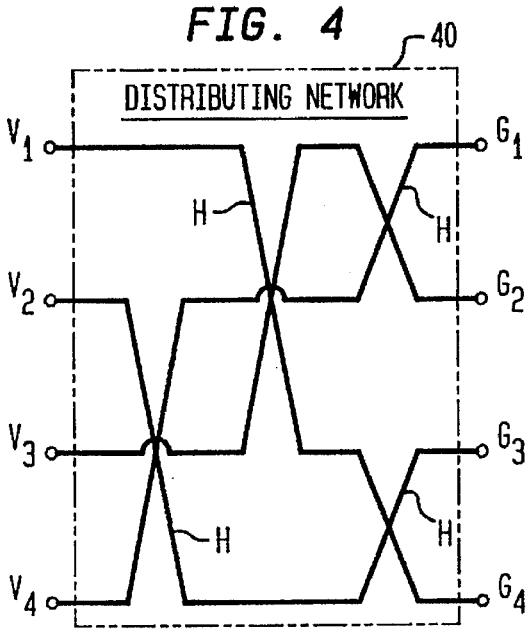
FIG. 4 is a schematic diagram of a distributing network, which may be used within the amplifier networks of FIGS. 2 or 3.

FIG. 4 shows a circuit diagram of an illustrative distributing network 40, which may be used for each of distributing networks 36 and 38 of FIG. 3. Distributing network 40 is a combination of four quadrature hybrid couplers H, interconnected as shown. Quadrature hybrid couplers, e.g., 3 dB branch-line couplers, are well known in the art and can be fabricated in a variety of transmission line mediums, such as in microstrip.

Figure 5:
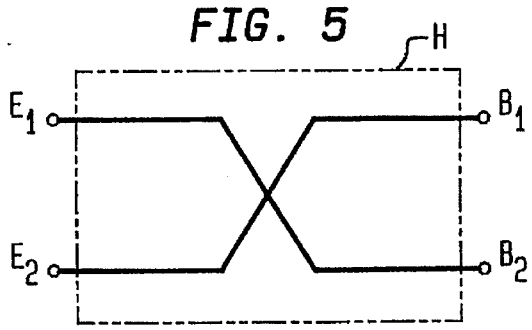
FIG. 5 is a schematic diagram of a quadrature hybrid coupler used within the network of FIG. 4.

FIG. 5 is a schematic representation of quadrature hybrid coupler H. Assuming −3 dB coupling values, RF power applied to input port $E_1$ is split equally between output ports $B_1$ and $B_2$. The signal or signal portion output at port $B_2$ is −90° out of phase relative to the signal portion at $B_1$. Similarly, a signal applied to input port $E_2$ will produce signals at $B_1$ and $B_2$, where the signal at port $B_1$ lags that at port $B_2$ by 90°. Assuming −3 dB couplings and that the couplers are ideal and matched at all ports, reflections can be assumed to be zero at the coupler ports. The transfer function, therefore, may be calculated using transmission coefficients rather than two-port S-parameters.

Referring again to FIG. 4, each input signal or signal portion present at any one of input ports $V_1$–$V_4$, is split into four signal portions and distributed via the coupler paths to each of output ports $G_1$, $G_2$, $G_3$ and $G_4$. Accordingly, each of output ports $G_1$–$G_4$ contains elements of each of the input signals but at different phases. In particular, the voltage level of each output signal present at each output port $G_1$–$G_4$, due to a given input signal at any one of ports $V_1$–$V_4$, is proportional to the voltage level of the input signal. When them are X output ports, the proportion of the voltage level of a signal at any one of the output ports in comparison to the voltage level of a signal applied to an input port is $1/\sqrt{X}$ or $X^{-1/2}$. It is noted that the square root relationship holds because power is conserved.

TABLE 1

| | $V_1$ | $V_2$ | $V_3$ | $V_4$ |
|---|---|---|---|---|
| $G_1$ | 0° | −90° | −90° | −180° |
| $G_2$ | −90° | 0° | −180° | −90° |
| $G_3$ | −90° | −180° | 0° | −90° |
| $G_4$ | −180° | −90° | −90° | 0° |

Table 1, as illustrated above, depicts the phase shifting characteristics of distributing network 40. For example, a signal present at input $V_1$ of network 40 has a zero degree phase shift present at output port $G_1$, a −90° phase shift at output ports $G_2$ and $G_3$ and a −180° phase shift at output port $G_4$. (These phase shifts are relative to one another). Further, the signal group delays attributed between each respective input port $V_1$–$V_4$, and output ports $G_1$–$G_4$, is equal for all sixteen paths. It is to be appreciated that the above reference to power distribution, voltage levels, phase shifting and delays relative to signals applied to network 40 is well known to one ordinarily skilled in the art.

In one embodiment of power sharing amplifier network 22*a* of FIG. 3, a distributing network 40 replaces first distributing network 36, and another distributing network 40 replaces second distributing network 38. This pair of distributing networks 40 can be used for first and second distributing networks 36 and 38 by using the following orientations: for network 36, first input ports $IP_1$–$IP_4$ are replaced with respective input ports $V_1$–$V_4$ of network 40; first output ports 31-1 to 31-4 are replaced with output ports $G_1$–$G_4$, respectively. For network 38, second input ports 33-4 to 33-1 are replaced with output ports $G_1$–$G_4$, respectively; second output ports $OP_1$–$OP_4$ are replaced with input ports $V_1$–$V_4$, respectively. Hence, the same part can be used for networks 36 and 38 but with the input and output ports reversed. With these orientations, the amplified composite signals from amplifiers $A_1$ to $A_4$ will be redistributed within second distributing network 38 such that amplified, reconstructed signals $S_1'$–$S_3'$ and $S_R'$, indicative of respective input signals $S_1$–$S_3$ and $S_R$, appear at respective output ports $OP_1$–$OP_4$. Reconstruction is possible due to the amplitude and phase relationships between corresponding signal portions of the amplified composite signals - - - as such, it is preferable for amplifiers $A_1$–$A_4$ to each have the same insertion phase delay so that the proper phase relationships are maintained at the input ports 33-4 to 33-1 of second distributing network 38. One skilled in the art can readily derive, using Table 1, how signals $S_1'$–$S_3'$ and $S_R'$ are reconstructed within second distributing network 38, and therefore, derivation will not be presented here.

Figure 6:
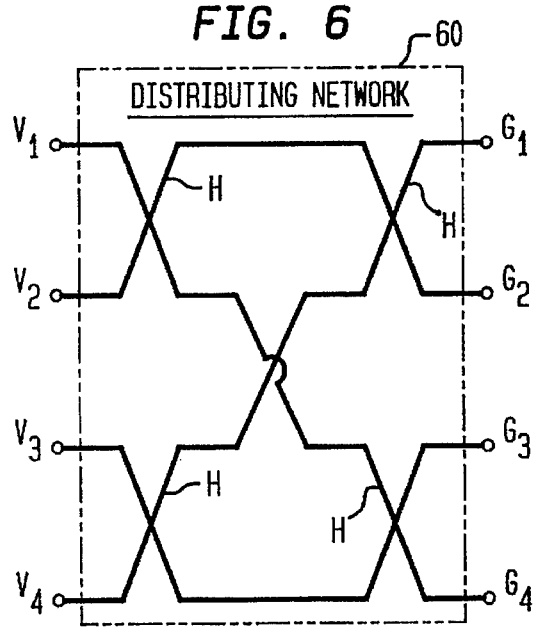
FIG. 6 shows a schematic diagram of an alternate distributing network, which can be used within the amplifier networks of FIGS. 2 or 3.

FIG. 6 is a schematic diagram of an alternate distributing network 60, which may be used for each of distributing networks 36 and 38 of FIG. 3. Distributing network 60 employs four hybrid couplers H, whose functional characteristics were described above. Table 2 below depicts the relative phase relationships of signals on output ports $G_1$–$G_4$ of network 60 that result from individual signals being applied to input ports $V_1$–$V_4$ of network 60. For instance, a signal applied to input port $V_2$ produces a signal on each output port $G_1$, $G_2$, $G_3$ and $G_4$, where the signal on port $G_1$ has a relative phase of −90°, the signal on port $G_2$ has a relative phase of −180°, and so forth.

In another embodiment of power sharing amplifier network 22*a* of FIG. 3, a pair of distributing networks 60 are used for first and second distributing networks 36 and 38 by using the same port orientations as was described above for the use of distributing networks 40 therein. With such orientations, amplified, reconstructed signals $S_1'$–$S_3'$ and $S_R'$, indicative of respective input signals $S_1$–$S_3$ and $S_R'$ appear at respective output ports $OP_1$–$OP_4$. One skilled in the art can readily ascertain, using Table 2, the manner in which signals $S_1'$–$S_3'$ and $S_R'$ are reconstructed.

TABLE 2

| | $V_1$ | $V_2$ | $V_3$ | $V_4$ |
|---|---|---|---|---|
| $G_1$ | 0° | −90° | −90° | −180° |
| $G_2$ | −90° | −180° | 0° | −90° |
| $G_3$ | −90° | 0° | −180° | −90° |
| $G_4$ | −180° | −90° | −90° | 0° |

Distributing networks 40 or 60 can be readily modified for use in conjunction with more or less amplifiers $A_1$–$A_N$ and input signals $S_1$–$S_N$. Specifically, either distributing network 40 or 60 can be modified so that $K=2^M$ output ports, $G_1$ to $G_K$, and $2^M$ input ports $V_1$ to $V_K$ are provided, for use in conjunction with $2^M$amplifiers $A_1$ to $A_K$, where M is an integer. It is noted that, whatever configuration is used for distributing networks 36 and 38, the number of input signals (including signal $S_R$) may be less than the number of input ports and the number of output ports. In this case, power sharing of each input signal among the amplifiers will still be achieved, but there will be unused input ports of network 36 and unused output ports of network 38.

It is further noted that other arrangements may be used for distributing networks 36 and 38 to effect power sharing among amplifiers $A_1$–$A_N$. For example, a first Butler Matrix may be used for first distributing network 36, having input ports for receiving input signals $S_1$–$S_N$. A second Butler Matrix identical to the first Butler Matrix may be used for second distributing network 38. With this configuration, reconstruction of output signals $S_1'$–$S_N'$ will occur if the output ports of the second Butler Matrix are used to receive the amplified composite signals from amplifiers $A_1$–$A_N$, so that signals $S_1'$–$S_N'$ appear on the input ports of the second Butler Matrix.

Figure 7A:
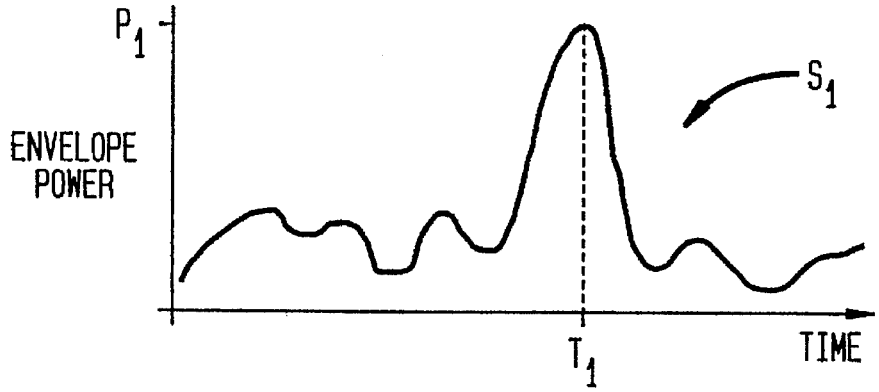
FIGS. 7A–7C show exemplary input signal waveforms.
Figure 7B:
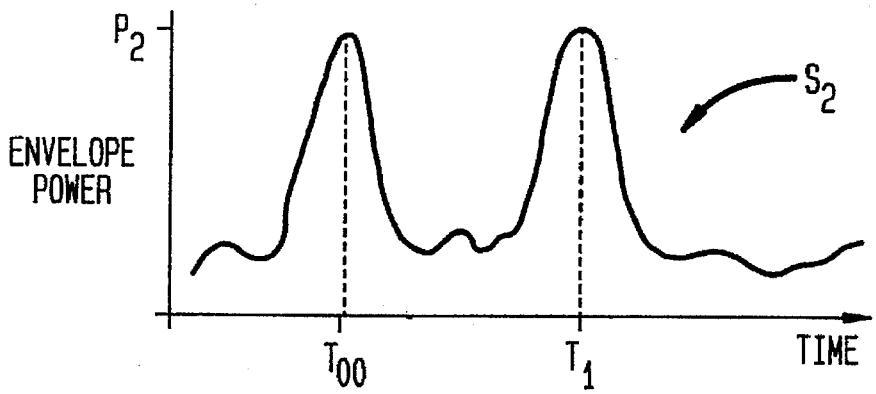
Figure 7C:
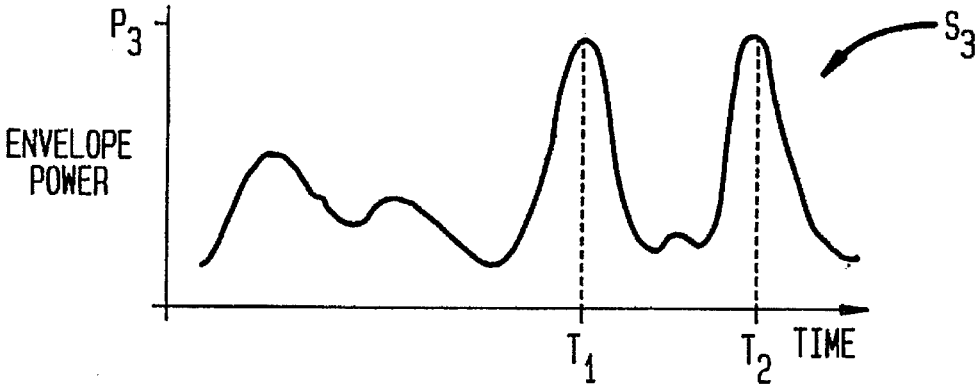
Figure 8A:
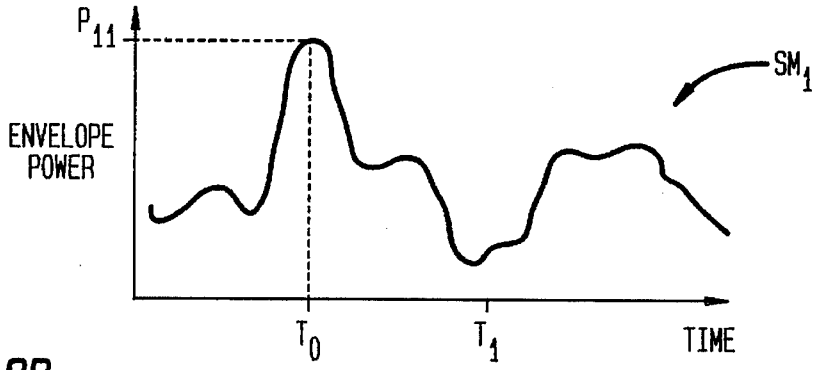
FIGS. 8A–8D show exemplary composite signal waveforms in the absence of a redistribution signal.
Figure 8B:
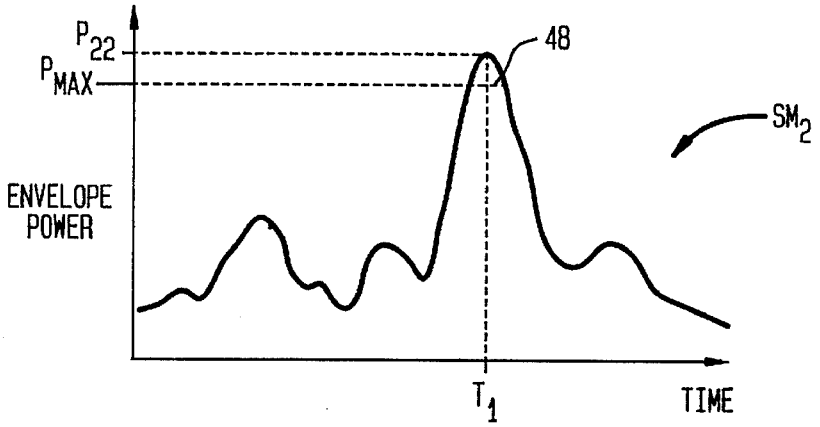
Figure 8C:
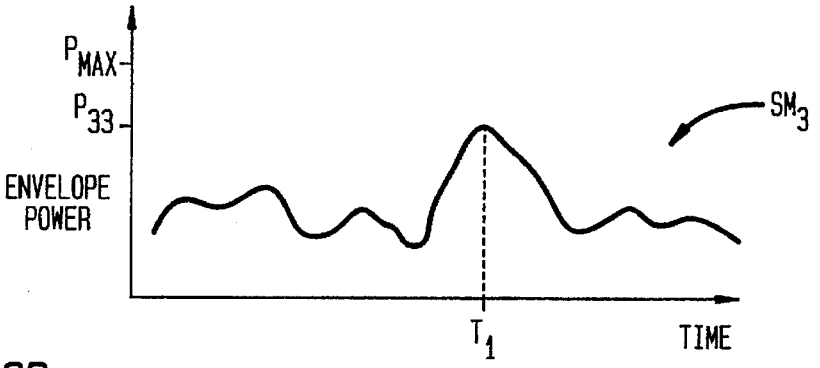
Figure 8D:
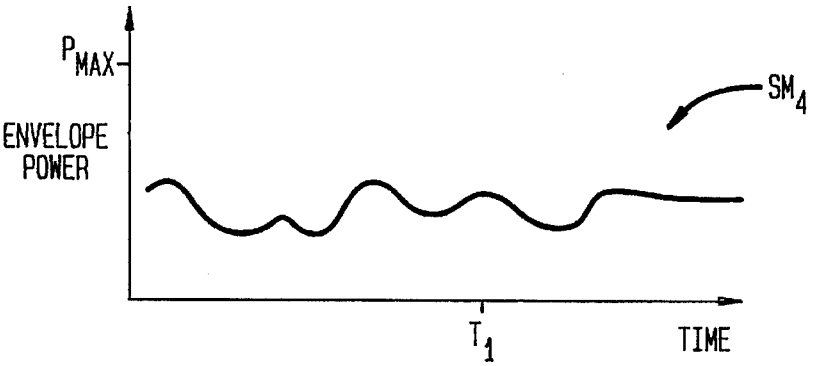

FIGS. 7A–7C illustrate exemplary signal envelope power waveforms vs. time for multi-tone input signals $S_1$–$S_3$, respectively. Each signal $S_1$–$S_3$ is comprised of a plurality of modulated carriers of different frequencies. For example, each signal $S_1$–$S_3$ can consist of 12 randomly phased carriers, where each carrier is equally spaced from the other and modulated using narrowband FM. The sinusoidal components of each signal add randomly in and out of phase, resulting in periodic peaking in the waveforms. For instance, each signal $S_1$–$S_3$ has a peak at time $T_1$ at a respective power level $P_1$, $P_2$ or $P_3$. Signals $S_2$ and $S_3$ have additional peaks at times $T_{00}$ and $T_2$, respectively.

Generally, the time domain envelopes of multi-carrier signals $S_1$–$S_N$ (and of each composite $SM_i$) are very similar to envelopes characterized by Rayleigh fading, especially when the number of carriers in a given signal is greater than ~10. Indeed, Rayleigh fading is a result of multipath, which is the addition of random vectors. Except for the very low probability tails, the probability distributions generally do not change as a function of the number of carriers in a given signal. When sinusoidal signals of different frequencies are combined to form a composite FDM signal such as $S_1$–$S_3$, the minimum spacing between envelope peaks is inversely proportional to the spacing between the lowest and highest frequencies within the FDM signal. For instance, if the lowest and highest carriers of signal $S_3$ in FIG. 7C are 600 kHz apart, then the time between adjacent peaks at $T_1$ and $T_2$ would be a minimum of 1/600 kHz=1.667 microseconds.

Signal waveforms resulting from the superposition of a plurality of random sinusoidal signals have been characterized in the prior art. See, for example, W. R. Bennett, "Distribution of the Sum of Randomly Phased Components", Quart, Applied Math., 5, No. 4, January 1948, pp 385–393, and M. Slack, "The Probability Distributions of Sinusoidal Oscillations Combined in Random Phase", J.I.E.E., 93, 1946, pp 76–86.

FIGS. 8A–8D show exemplary envelope power waveforms vs. time for composite signals $SM_1$–$SM_4$, respectively in the absence of redistribution signal $S_R$. The shown waveforms are typical of those that may result from the application of signals $S_1$–$S_3$ of FIGS. 7A–7C to respective input ports $IP_1$–$IP_3$ of first distributing network 36 (FIG. 3). It is readily apparent that the three uncorrelated signal envelopes of signals $S_1$–$S_3$ add up differently at each of the four amplifiers. Signal $SM_1$ peaks to a power level $P_{11}$ at time $T_0$, and then falls to a null at time $T_1$. Signal $SM_2$ peaks to a level $P_{22}$ higher than $P_{MAX}$ at time $T_1$, in which $P_{MAX}$ is the power level where clipping will occur in the respective amplifier $A_2$ (as indicated by dotted line 48). Signal $SM_3$ (FIG. 8C) has a moderate peak of power level $P_{33}$ at time $T_1$. Signal $SM_4$ has no significant peaks during the time interval shown.

Typically, when amplifying multiple tones, it is desirable to design a conventional amplifier for a peak power capability of 7–10 times the average power rating. Peaking occurs on a voltage squared basis, such that, in the absence of a redistribution signal, the peak to average power ratio can rise well in excess of the 7–10 factor desired. Consequently, clipping can occur, and the IMD products generated by the amplifier can become excessive.

Accordingly, it is desirable to reduce the highest peaks among composite signals $SM_1$–$SM_4$ so that the amplifiers clip less often. The application of redistributing signal $S_R$ provides this result. By applying redistribution signal $S_R$ to input port $IP_4$, the peaks in the waveforms for signals $SM_1$ and $SM_2$ in respective FIGS. 8A and 8B will be diminished such that each resulting waveform will resemble that of FIG. 8D. In the example, this can be effectuated by applying signal $S_R$ as substantially the same signal as signal $SM_1$ (but 180° out of phase at the input to amplifier A1), during a time interval centered about time $T_0$. Likewise, during a time interval centered about time $T_1$, signal $S_R$ is substantially the same signal as signal $SM_2$, but 180° out of phase at the input to amplifier $A_2$. When signal $S_R$ is applied in this manner, partial or total signal cancellation of signals $SM_1$ and $SM_2$ occurs at the respective amplifiers at those times, thereby reducing the peak powers $P_{11}$ and $P_{22}$. Similarly, peaks in signals $SM_3$ and $SM_4$ may be reduced at other times in analogous fashion. The amount of instantaneous peak power reduction depends upon the amplitude of signal $S_R$ relative to that of the composite signal to be reduced.

During times in which the peak envelope power of each composite signal is below a pre-defined peak power threshold "$P_{THRESH}$", where IMD product generation in the amplifiers is at an acceptable low level, application of redistribution signal $S_R$ can be suspended. It is desirable to avoid introduction of signal $S_R$ when each composite signal is below $P_{THRESH}$, because such introduction will typically raise peak power of at least one composite signal, possibly causing unacceptable IMD product generation in the corresponding amplifier.

It is noted that the amplification system of FIG. 2 is also useful for reducing peak power levels of the composite signals $SM_1$–$SM_N$ when the input signals $S_1$–$S_N$ are each comprised of a single carrier, modulated or unmodulated. Because the composite signal formed at each amplifier input is comprised of a different vector sum of the input signals, peaking at each amplifier will occur at different times. The redistribution signal can thus be applied to reduce the highest composite signal at any given time, analogous to the multi-carrier input signal case described above.

A special case of the single carrier input signal case is where each input signal is at the same power level. By way of example, if three input signals $S_1$–$S_3$ are applied at 10 mW each, and four amplifiers $A_1$–$A_4$ are employed, then a worst case phase line-up will result in an unequal power distribution of 12.5, 2.5, 2.5 and 2.5 mW at the four amplifiers, in the absence of the redistribution signal. When the redistribution signal is applied at such time, a substantially even power distribution at the amplifier inputs can be obtained.

Figure 9:
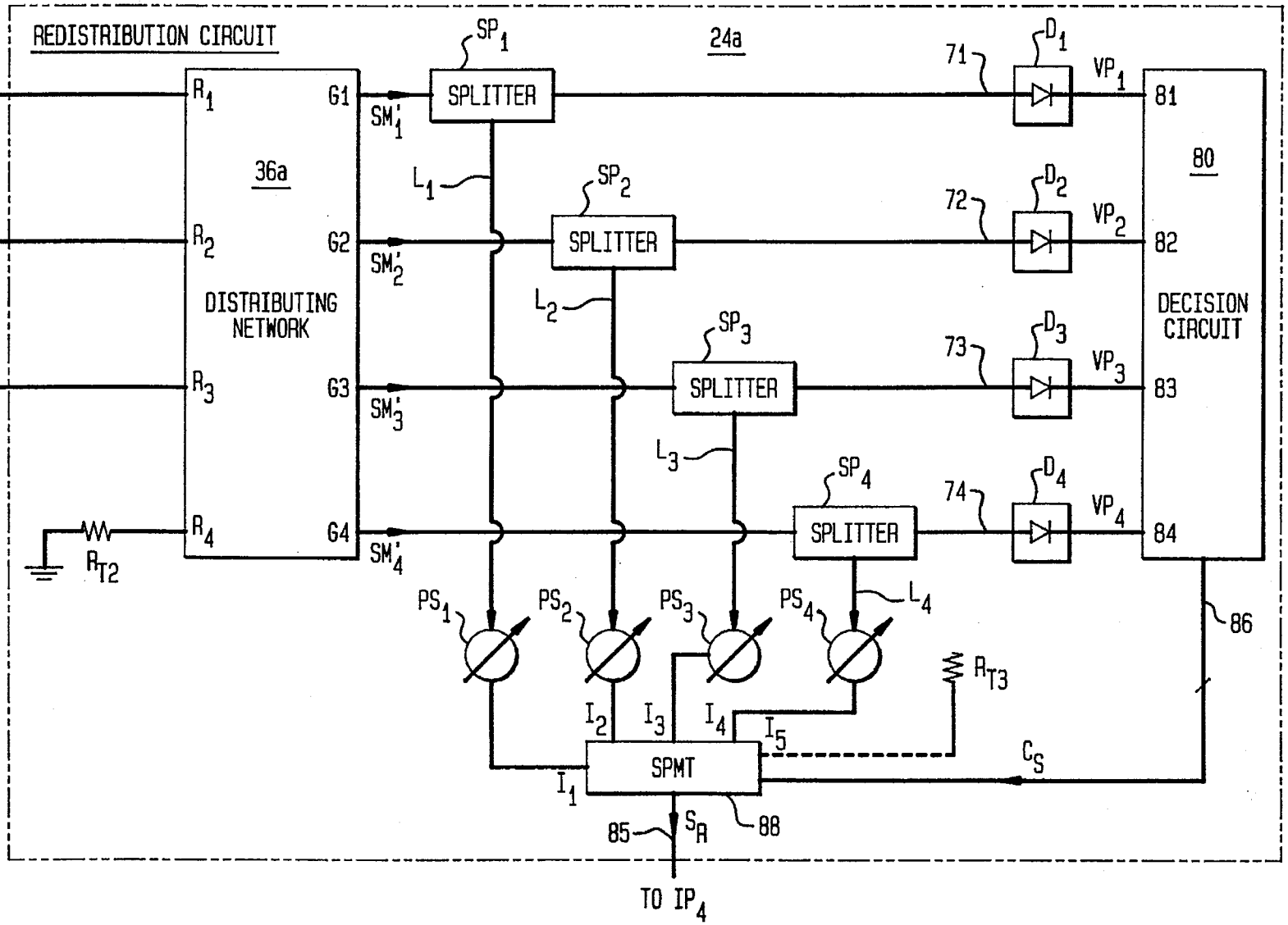
FIG. 9 is schematic block diagram of an exemplary redistribution circuit.

Referring to FIG. 9, an exemplary block diagram of the redistribution circuit is shown, designated generally as **24*a*. For purposes of illustration, redistribution circuit 24*a* will be described as having four input ports $R_1$–$R_4$, and as deriving signal $S_R$ from three input signals applied to input ports $R_1$–$R_3$ from power splitters $C_1$–$C_3$, respectively. This configuration is consistent with power sharing network 22 (FIG. 2) having four input ports and four output ports. It is understood, however, that redistribution circuit 24*a* can be readily modified to derive signal $S_R$ from more or fewer than three input signals, as the case may be, consistent with the configuration for amplifier network 22**.

The input signals $S_1$–$S_3$ from splitters $C_1$–$C_3$ are received by distributing network **36*a*, which is preferably identical to distribution network 36 described above in reference to FIG. 3. Hence, if distributing network 40 is used for network 36, the same network 40 is used for network 36*a*; if network 60 is employed for network 36, it is also employed for network 36*a*. (In FIG. 9, input ports $R_1$–$R_4$ correspond to input ports $V_1$–$V_4$, respectively, of FIG. 4 or 6). Then, with couplers $C_1$–$C_3$ (FIG. 2) preferably having substantially identical coupling values, and with input port $R_4$ terminated in resistor $R_{T2}$, composite signals $SM_1'$–$SM_4'$ will be provided on respective output ports $G_1$–$G_4$. Signals $SM_1'$–$SM_4'$ have substantially the same waveforms that respective signals $SM_1$–$SM_4$ of FIG. 3 would have in the absence of redistribution signal $S_R$, such as the waveforms shown in FIGS. 8A and 8D. (Typically, however, the amplitude of each signal $SM_1'$–$SM_4'$ is scaled with respect to signals $SM_1$–$SM_4$, as will be explained below). Signals $SM_1'$–$SM_4'$ are applied to respective power splitters $SP_1$–$SP_4$, where each is split between an associated first output port 71–74 and an associated second output port $L_1$–$L_4$. The signals on ports 71–74 are supplied to peak envelope detectors $D_1$–$D_4$, respectively. Detectors $D_1$–$D_4$ produce respective time varying voltages $VP_1$–$VP_4$, each indicative of the instantaneous peak envelope power of an associated signal $SM_1'$–$SM_4'$. Voltages $VP_1$–$VP_4$ are provided to input ports 81–84, respectively, of decision circuit 80**.

In this embodiment, decision circuit 80 determines, from voltages $VP_1$–$VP_4$, which of signals $SM_1'$–$SM_4'$ has the highest instantaneous peak envelope power. A control signal $C_S$ is then provided on control lines 86 in accordance with this determination, to control the switch position of single pole multiple throw switch (SPMT) 88. In the shown illustrative case, switch 88 has input ports $I_1$–$I_4$, optional input port $I_5$, and output port 85. Phase shifters $PS_1$–$PS_4$ are coupled between respective switch input ports $I_1$–$I_4$ and splitter output ports $L_1$–$L_4$, respectively, and termination resistor $R_{T3}$ is coupled to optional switch input port $I_5$.

By way of example, prior to time $T_0$ (FIG. 8A), decision circuit 80 will determine that signal $SM_1'$ has the highest peak power of the four composite signals, and will supply control signal $C_S$ as a control word indicative of this condition. Control signal $C_S$ will then cause switch 88 to switch to switch input port $I_1$, thus electrically connecting output port 85 with input port $I_1$. Consequently, redistribution signal $S_R$ will at this time effectively comprise signal $SM_1'$ attenuated by splitter $SP_1$ and phase shifted by phase shifter $PS_1$. Then, at a time in between time $T_0$ but prior to time $T_1$ (FIG. 8B), the detected peak envelope power of signal $SM_2'$ will rise to a level higher than that of signal $SM_1'$. Decision circuit 80 will respond to this changed condition by altering the control word of signal $C_S$, in turn causing switch 88 to switch to input port I3. Signal $S_R$ then becomes composite signal $SM_2'$ attenuated by splitter $SP_2$ and phase shifted by phase shifter $PS_2$. This type of switching scheme is designated herein as "fast envelope cycle" switching, in that switching is performed on a relatively fast basis between the peaks of the waveforms. For instance, if the time interval between peaks of a given signal is on the order of 1 us, then the total switching time (corresponding to the time from which the change in the peak condition is detected until switch 88 changes position) is preferably less than about 50 ns.

Figure 1:
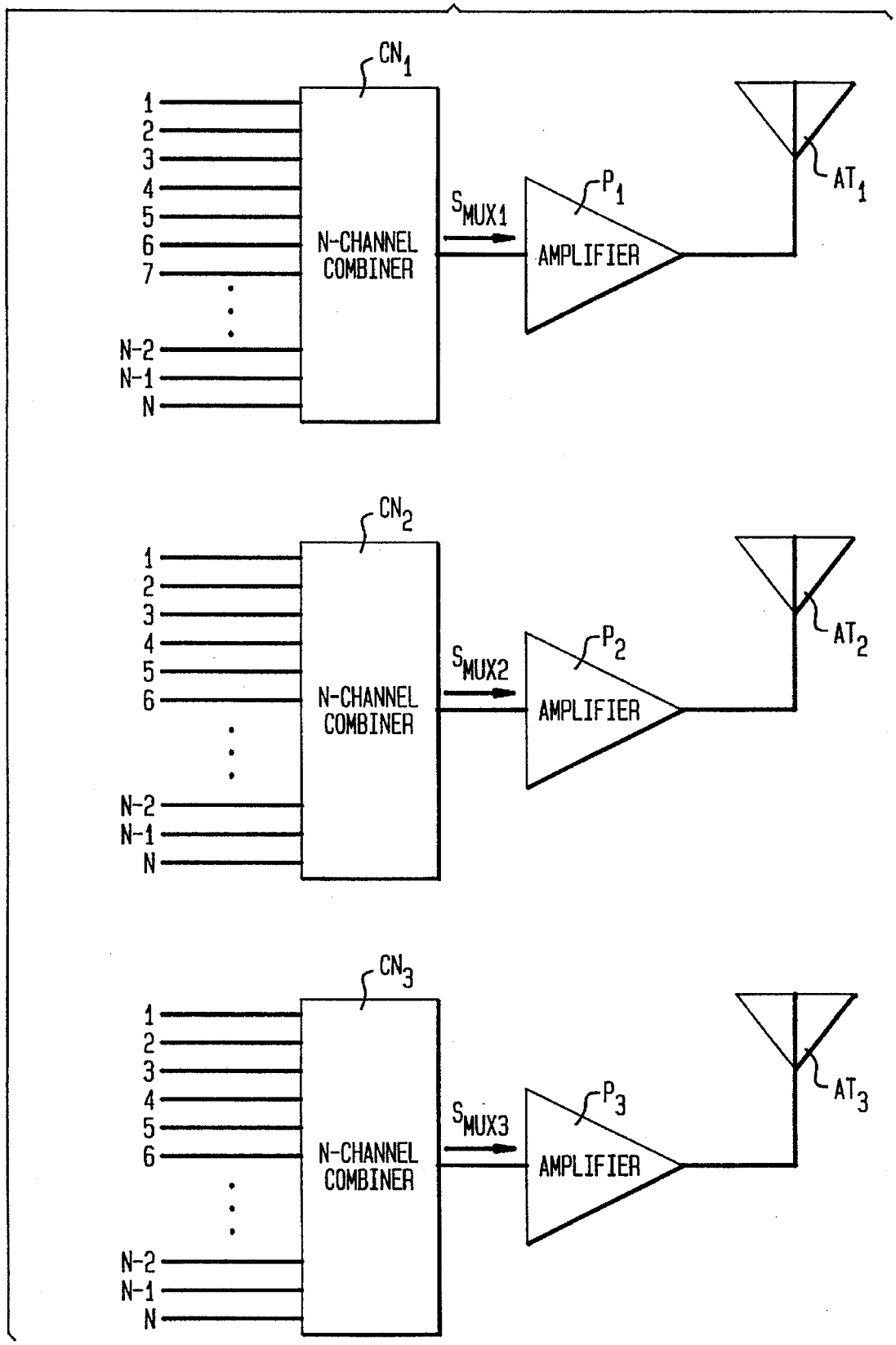
FIG. 1 (PRIOR ART)
FIG. 1 is a schematic diagram of a base station transmitter configuration of a prior art wireless communications system.

Redistribution signal $S_R$ is then applied to input port $IP_4$ of first distributing network 36 (FIG. 3). In order to achieve peak reduction within the associated composite signal $SM_1$–$SM_4$ of power sharing amplifier network 22*a*, signal $S_R$ is applied at input port $IP_4$ at a starting phase that will lead to at least partial vectorial cancellation of the associated signal $SM_1$–$SM_4$ having the highest peak power at any given time. Thus, phase shifters $PS_1$–$PS_4$ have phase shifts which will provide this result. For example, if either network 40 or 60 (see FIGS. 4 and 6) is used for distributing network 36, then phase shifters $PS_1$–$PS_4$ preferably have phase shifts of 0°, −90°, −90°, and −180°, respectively, so that signal $S_R$ will arrive 180° out of phase (after it is split up by network 36) with the corresponding signal $SM_1$–$SM_4$ to be reduced. These phase shift values can be discerned from Tables 1 or 2. To achieve effective peak power reduction, each transmission line $TL_1$–$TL_N$ of FIG. 1 is preferably of an electrical length equivalent to the electrical length of the path from each splitter $C_1$–$C_N$ through redistribution circuit 24, to input port $IP_{N+1}$ (in the present example, $IP_4$). Phase matching of these electrical paths will ensure that signal $S_R$ arrives at port $IP_4$ at the proper phase with respect to input signals $S_1$–$S_3$ at input ports $IP_1$–$IP_3$ to achieve effective peak reduction. Phase matching over a band of frequencies requires delay matching of the cables and circuits. Transmission lines $TL_1$–$TL_N$ thus function as delay lines.

The fast switching of redistribution signal $S_R$ between composite signals $SM_1'$–$SM_4'$ will cause severe AM and PM modulation of signal $S_R$, generating high sidebands therein. Since signal $S_R$ is amplified by each amplifier and re-constructed by second distributing network 38 (FIG. 3), it appears only at output port $OP_4$ (or $OP_{N+1}$, in the general case), where it is terminated by termination $R_{T1}$. Hence, the sidebands are reconstructed as well, and the output signals $S_1'$–$S_N'$ are free of these sidebands.

It is noted that in an alternate embodiment, a single variable phase shifter (not shown) could be coupled to switch output port 85 and replace phase shifters $PS_1$–$PS_4$. Such a phase shifter would have its phase shift controlled by another control signal from decision circuit 80, where the phase shift would be consistent with the determination of the switch position of switch 88.

The amplitude of redistribution signal $S_R$ can be selected based upon a tradeoff between the amount of peak power that can be reduced in the selected one of signals $SM_1$–$SM_4$, and the amount of peak and average power increase in the other signals $SM_1$–$SM_4$ during such times. The time percentage and the amount of clipping that can be tolerated within the amplifiers need also be considered in this determination. Basically, one can design for a maximum allowable peak to average power ratio P, where P is the ratio of the highest peak power incident upon any of the amplifiers, to the average power incident upon the amplifiers at any given time.

It has been found through simulation that a favorable choice for the power level of signal $S_R$, at any given time, is approximately one half the power level of the highest of input signals $S_1$–$S_N$ measured at the input ports of first distributing network 36. Thus, if the highest of input signals $S_1$–$S_3$ is 10 milliwatts at its respective input port $IP_1$–$IP_3$ at a given time, signal $S_R$ may be 5 milliwatts at input port $IP_4$ at such time. The desired power levels can be obtained by proper design of power splitters $C_1$–$C_N$ and $SP_1$–$SP_N$ in the general case.

There are instants in time where the application of the redistribution signal causes a peak reduction in one of the amplifiers at the expense of increasing the peak signal level in another (second) one of the amplifiers. This second amplifier may be near its maximum peak or clipping level already, and therefore the net effect may be detrimental at that instant of time. However, it has been shown that over periods of time, the application of the redistributing signal provides an overall reduction in peak power.

As mentioned above, switch 88 has an optional input port $I_5$, which is terminated. Optionally, decision circuit 80 can be configured to cause switch 88 to switch to input port $I_5$, via an appropriate control signal $C_S$, whenever the peak power of each signal $SM_1'$–$SM_4'$ falls below a predetermined threshold. Switching to terminated port $I_5$ temporarily suspends the application of signal $S_R$. As discussed above, this is preferable to avoid raising IMD product levels in the amplifiers when they are already at an acceptable low level.

Moreover, the application of the redistribution signal can optionally be suspended under the control of decision circuit 80 during instants of time when two or more of composite signals $SM_1$–$SM_4$ are close to the clipping (saturation) level. Suspending signal $S_R$ during these times will avoid the possibility of driving the non-selected signal too deep into the saturation region. Practically, however, one can design for a finite allowable time percentage of clipping, such as 0.05%.

Figure 10:
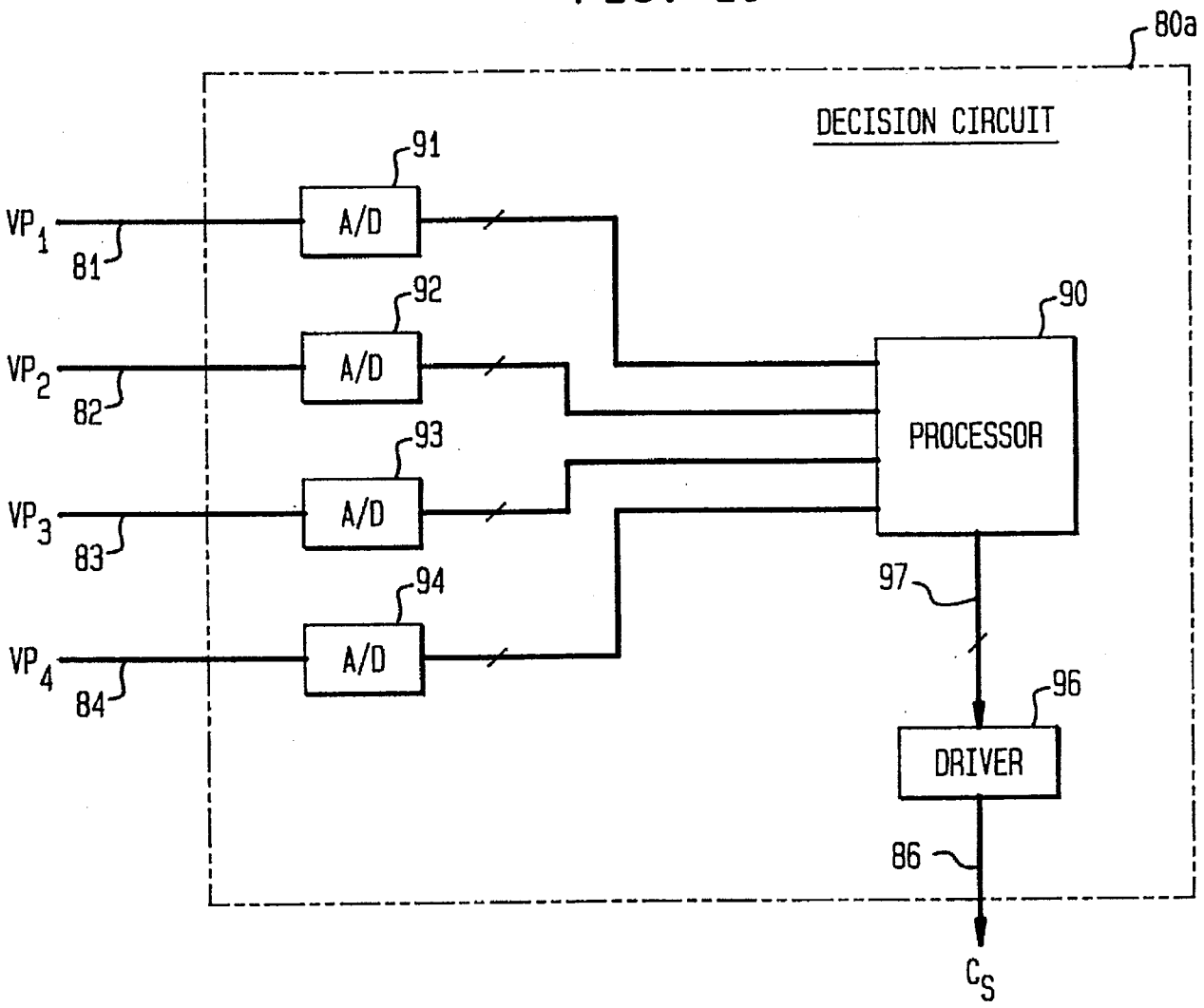
FIG. 10 is a block diagram of an exemplary decision circuit, which can be used within the redistribution circuit of FIG. 9.

FIG. 10 shows a block diagram of an exemplary decision circuit, designated as 80*a*. Decision circuit 80*a* typically includes analog to digital (A/D) converters 91–94 for converting the time varying voltages $VP_1$–$VP_N$ to digital codewords, which are supplied to processor 90. Processor 90 is equipped with a simple algorithm to compare the codewords from the A/D converters indicative of peak envelope power. Control signal $C_S$ is supplied by processor 90 in accordance with such comparison to driver 96 via control lines 97. Driver 96 converts control signal $C_S$ into a form suitable for application to switch 88.

For the fast envelope cycle switching approach discussed thus far, the peak power reduction performance of redistribution circuit 24*a* is typically inversely related to the reaction time of decision circuit 80 and the switching time of switch 88. This holds true only up to a point - - - if the reaction and switching times are much less than the envelope periods between peaks, then any further increase in the speeds will only marginally improve performance. As mentioned above, in some cases it is desirable for the total switching time to be less than about 50 ns. Speeds of this order can be obtained by configuring A/D converters 91–94 to sample approximately every 25 ns, and with processor 90, driver 96 and switch 88 each having reaction times of 10 ns or less. Alternatively, A/D converters 91–94 may be embodied as flash A/D converters to supply processor 90 with continuous control words at conversion speeds on the order of ten nanoseconds or less. A dock (not shown) within processor 90 would then enable the processor to extract the words every several nanoseconds to achieve the requisite speed.

It is understood that decision circuit 80 may be configured alternatively with analog circuitry including a series of comparators to compare the voltages $VP_1$–$VP_4$ and properly supply control signal $C_S$ in accordance with the comparisons. The design of such an analog decision circuit is within the capability of one skilled in the art and will therefore not be discussed further. Total switching time may be faster with the analog approach than with the digital approach presented above.

Figure 11:
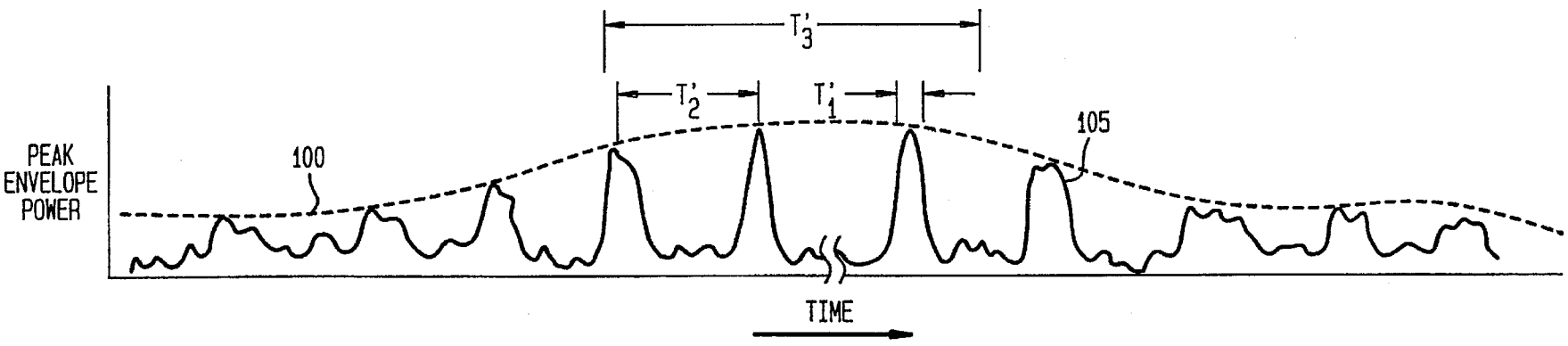
FIG. 11 shows exemplary slow envelope and fast envelope signal power waveforms.

Referring to FIG. 11, a typical peak envelope power waveform 105 is shown, which may be the waveform of any of signals $SM_1$–$SM_4$ (in the absence of redistribution signal $S_R$) when the carriers are modulated, as is typical in wireless telecommunications. (The case in which the input signals are comprised of modulated carriers, as opposed to un-modulated tones, has been described thus far. The invention is also applicable to the un-modulated tone case, which can result in composite signals with highly periodic peaks). The modulation removes some of the periodicity of the envelope, but medium and long term peaking still occurs, as indicated by dotted line 100, which represents a slow envelope waveform. As an alternative to the fast envelope switching approach discussed above, a "slow envelope cycle" approach may be utilized to reduce peak envelope power. With the latter approach, the redistribution signal $S_R$ does not change as fast as it does in the fast envelope method.

The slow envelope approach can be implemented by generating slow envelope waveform 100, which is the envelope of the peaks of waveform 105. This can be realized by processing the outputs of the peak envelope detectors by various forms of low pass filtering (including non-linear forms such as asymmetrical charge/discharge circuits), so that each time varying waveform $VP_1$–$VP_4$ resembles waveform 100. The time duration $T_3'$ of waveform 100 represents the time that peak envelope power is close to the maximum of waveform 100, e.g., within 0.5 dB of the maximum. Within time duration $T_3'$ there may be many narrow peaks of duration $T_1'$, for example, 10–20 narrow peaks spaced apart by time interval $T_2'$. Thus, time interval $T_3'$ may be many microseconds long, or even seconds long or more, depending on the carrier tone spacings, the modulation formats, etc. One important case is where each composite signal $SM_i$ is comprised of a number of narrowband FM modulated carriers combined together, which are equally spaced in frequency and locked to the same frequency reference. Because the audio modulation is AC coupled, the individual carrier phases fluctuate around a central reference phase, spending a majority of time within approximately ±20° of the reference. This can produce long peaking time intervals $T_3'$.

With the slow envelope method, decision circuit 80 can sample each slow envelope waveform $VP_1$–$VP_4$ and perform comparisons at a much slower rate than is required for the fast envelope case. The switch positions of switch 88 may then be caused to change at the slower rate; however, the redistribution signal $S_R$ will still resemble the fast envelope waveform. In the slow envelope switching approach, signal $S_R$ will generally consist of the selected one of signals $SM_1'$–$SM_4'$ for longer durations than in the fast envelope approach.

Figure 12:
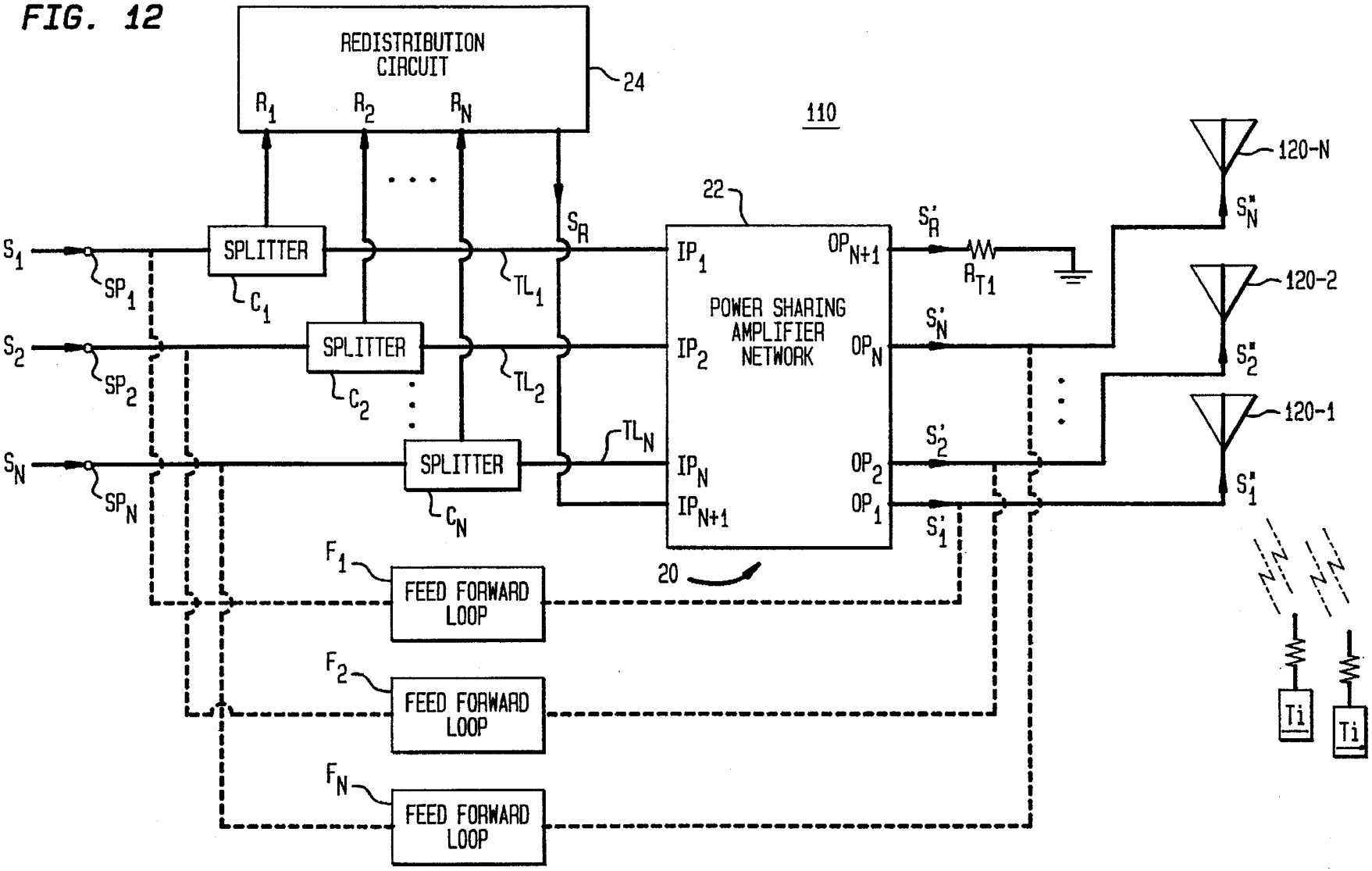
FIG. 12 is a block diagram of a portion of a wireless telecommunication system in accordance with the present invention.

FIG. 12 is a schematic block diagram of a portion of an N-sector wireless telecommunication system, designated generally as 110, which includes amplification system 20 of FIG. 2. Optionally, feed-forward loops $F_1$–$F_N$ are coupled between respective input ports $SP_1$–$SP_N$ and output ports $OP_1$–$OP_N$, and function to cancel distortion products within the output signals. As a result, output signals $S_1''$–$S_N''$ are provided to respective directional antennas 120-1 to 120-N and typically exhibit lower distortion than corresponding signals $S_1'$–$S_N'$. Suitable configurations for feed-forward loops $F_1$–$F_N$ are disclosed in my co-pending U.S. patent application Ser. No. 08/542,480, filed Oct. 13, 1995. Briefly, each feed-forward loop couples a portion of a corresponding input signal $S_1$–$S_N$, and vectorially combines the coupled input signal with a coupled portion of a corresponding output signal $S_1'$–$S_N'$. (It is noted that power splitters $C_1$–$C_N$ may each be configured as 1×3 splitters rather than as 1×2 splitters to provide the input signal coupling function). This produces correction signals containing primarily distortion products, which are amplified and then vectorially combined with signals $S_1'$–$S_N'$. Consequently, distortion products are canceled within signals $S_1'$–$S_N'$ to produce low distortion output signals $S_1''$–$S_N''$. Antennas 120-1 to 120-N transmit the multiplexed output signals to wireless terminals $T_i$ disposed within angular sectors associated with the antennas. Preferably, the same antennas 120-1 to 120-N are used to receive communication signals from terminals $T_i$, such that the received signals are routed to a base station receiver via appropriate duplexers (both not shown).

One advantage of a typical embodiment of the present invention is that because peak power is reduced, smaller active devices may be utilized within the amplifiers of the power sharing amplifier network, thereby reducing amplifier complexity and cost. Another advantage of reducing peak power is higher reliability due to lower junction temperatures within the active devices of the amplifiers. Moreover, higher amplifier efficiency can be achieved as a result of the peak power reduction. In wireless telecommunication applications, the combination of average power sharing (due to the power sharing amplifier network) and the peak power reduction technique disclosed herein results in significant cost reduction and/or superior capability of the base station transmitter. The average power sharing allows more subscribers to effectively use a system with a given number of amplifiers on a statistical basis. Average power is shared concomitantly with reduced peak power.

The embodiments disclosed above may be modified so that the redistribution circuit provides multiple redistribution signals to corresponding multiple unused input ports of the first distributing network. This may be desirable when two or more of the amplifiers are equally close to an overload condition. Two redistribution signals could then be employed to reduce peak power in two corresponding ones of composite signals $SM_1$–$SM_4$. The multiple redistribution signals could be provided by replacing the single pole, M throw switch with a double (or multiple) pole, M throw switch and by employing a suitable algorithm within the decision circuit to optimally select the redistribution signals. Moreover, the circuitry and algorithm may be expanded such that optimized amplitude and phase values of one or more redistribution signals are continuously computed. The computed values could then be effectuated by employing variable phase shifters and variable attenuators in the redistribution signal paths.

The embodiments disclosed above may also be modified such that the non-selected composite signals $SM_1$ to $SM_N$ are monitored for new peaking conditions whenever redistribution signal $S_R$ is applied to reduce peak power in a selected one of signals $SM_1$–$SM_N$. This may be implemented by adding couplers between the first distributing network output ports and the amplifiers to couple a sample of each of signals $SM_1$ to $SM_N$. These signal samples could then be applied to additional peak envelope detectors, each followed by a threshold detector. The threshold detectors could then supply a control signal to the single or multiple throw switch to suspend the application of the redistribution signal whenever a peak power threshold is exceeded.

It will be understood that the embodiments disclosed herein are merely exemplary and that one skilled in the art can make many modifications and variations to the disclosed embodiments without departing from the spirit and scope of the invention. All such modifications and variations are intended to be included within the scope of the invention as defined by the appended claims.

What is claimed is:

1. An apparatus for amplifying a plurality of input signals, comprising:

a first distributing network for splitting each one of said plurality of input signals among a plurality of first output ports, to thereby provide a set of first signals;

a redistribution circuit for providing a redistribution signal derived from said input signals, said redistribution signal being applied to said first distributing network and having signal characteristics selected to provide reduction in peak envelope power within at least one signal of said set of first signals;

a plurality of amplifiers for amplifying said set of first signals in a power-sharing arrangement to provide a set of amplified signals; and a second distributing network for receiving said set of amplified signals and generating therefrom a plurality of reconstructed output signals, each indicative of a corresponding one of said input signals.

2. The apparatus according to claim 1, wherein said redistribution signal provides reduction in peak envelope power of a selected signal of said set of first signals having the highest peak power within said set of first signals.

3. The apparatus according to claim 2, wherein said redistributing signal has signal waveform characteristics substantially identical to signal waveform characteristics of said selected signal having the highest peak power within said set of first signals, and further wherein said redistributing signal is substantially 180 degrees out of phase with said selected signal at an associated amplifier of said plurality of amplifiers, whereby at least some peak power of said selected signal is canceled thereat.

4. The apparatus according to claim 2, wherein said redistributing signal is substantially an attenuated replica of said selected signal.

5. The apparatus according to claim 1 wherein each said input signal comprises at least one modulated radio frequency (RF) signal.

6. The apparatus according to claim 1, wherein said redistribution circuit includes a third distributing network substantially identical to said first distributing network, and wherein said apparatus further includes a plurality of first power splitters, each for splitting an associated one of said input signals between an associated first input port of said first distributing network and an associated third input port of said third distributing network.

7. The apparatus according to claim 6, wherein said third distributing network includes a plurality of third output ports and is operable to split each of said input signals applied to said third input ports among said plurality of third output ports to provide a composite signal on each said third output port having signal power of all said input signals, and wherein said redistribution circuit further includes:

a plurality of second splitters, each for splitting an associated one of said composite signals between first and second output ports thereof;

a plurality of peak envelope detectors, each coupled to an associated one of said first output ports of said second splitters, each for detecting peak envelope power of an associated composite signal;

a decision circuit coupled to said peak envelope detectors, for comparing peak envelope power detected by said peak envelope detectors and for generating a control signal indicative of the composite signal with the highest instantaneous peak envelope power; and a single pole, multiple throw switch having a plurality of switch input ports coupled to associated ones of said second output ports of said second splitters, and having a switch output port coupled to an input port of said first distributing network, said switch operable to electrically connect said switch output port to one of said switch input ports responsive to said control signal to thereby provide said redistribution signal as a selected one of said composite signals at any given time on said switch output port.

8. The apparatus according to claim 7, further comprising means for phase shifting said redistribution signal by a phase shift in dependence upon the composite signal determined to have the highest peak envelope power.

9. The apparatus according to claim 8, wherein said means for phase shifting comprises a plurality of phase shifters, each coupled between an associated one of said switch input ports and said second output ports of said second splitters, and each having a predetermined phase shift in accordance with an associated one of said composite signals.

10. The apparatus according to claim 1, wherein said first, second and third distributing networks each comprise a plurality of quadrature hybrid couplers.

11. The apparatus according to claim 1, wherein said first, second and third distributing networks each comprise a Butler Matrix.

12. The apparatus according to claim 7, wherein said decision circuit includes:

a plurality of analog to digital (A/D) converters, each for converting a detected output voltage from an associated one of said peak envelope detectors into a digital codeword; and a processor for receiving said digital codewords from said A/D converters, and operable to determine therefrom which of said composite signals is of the highest peak power level, said processor further operable to supply said control signal as a control word responsive to said determination.

13. The apparatus according to claim 2, wherein said redistributing circuit is operable to provide said redistributing signal only during time intervals in which peak envelope power within said set of first signals is otherwise above a predetermined minimum threshold.

14. The apparatus according to claim 12, wherein said decision circuit is operable to cause said switch to switch positions at a rate commensurate with a slow envelope cycle of said composite signals.

15. A wireless communication system, comprising:

A) a plurality of directional transmitting antennas;

B) a transmitter section including an apparatus for amplifying a plurality of input signals, said apparatus being coupled to said plurality of antennas, wherein said apparatus comprises:

i) a first distributing network for receiving a plurality of radio frequency (RF) input signals and generating therefrom a set of RF composite signals, with each composite signal having signal power of each of said RF input signals;

ii) a redistribution circuit for providing a redistribution signal derived from said input signals, said redistribution signal being applied to said first distributing network and having signal characteristics selected to provide reduction in peak envelope power within at least one of said composite signals;

iii) a plurality of RF amplifiers coupled to said first distributing network for amplifying said set of first RF composite signals in a power-sharing arrangement to provide a set of amplified signals; and iv) a second distributing network coupled to said plurality of RF amplifiers for receiving said set of amplified signals and generating therefrom a plurality of amplified, reconstructed output signals each indicative of an associated one of said plurality of RF input signals.

16. The communication system according to claim 15, further comprising a feed-forward loop for generating a correction signal derived from an associated one of said reconstructed output signals, and for vectorially combining said correction signal with said associated RF output signal to reduce distortion within said associated RF output signal.

17. A method for amplifying a plurality of input signals, comprising:

splitting each one of said input signals into a signal portion on each of a plurality of first circuit ports, with a predetermined amplitude and phase relationship between signal portions of a given input signal, wherein a composite signal is formed on each said first circuit port having signal power of each of said input signals;

vectorially combining a redistribution signal with each said composite signal to reduce peak envelope power within at least one of said composite signals;

separately amplifying each said composite signal to produce amplified composite signals; and recombining said amplified composite signals to form a plurality of amplified, reconstructed output signals, each indicative of an associated one of said input signals.

18. The method according to claim 17, further comprising radiating each output signal towards wireless terminals disposed within angular sectors associated with each said output signal.

19. The amplifier network according to claim 1, wherein each of said amplifiers has substantially the same gain and insertion phase delay.

20. The amplifier network according to claim 1, wherein said first and second distributing networks are of substantially the same circuit configuration.

21. An apparatus for amplifying a plurality of input signals, comprising:

first distributing network means for splitting each one of said input signals among a plurality of first output ports, to thereby provide a set of first signals;

circuit means for providing a redistribution signal derived from said input signals, said redistribution signal being applied to said first distributing network and having signal characteristics selected to provide reduction in peak envelope power within at least one signal of said set of first signals;

amplifier means for amplifying said set of first signals in a power-sharing arrangement to provide a set of amplified signals; and second distributing network means for receiving said set of amplified signals and generating therefrom at least one amplified, reconstructed output signal indicative of said at least one input signal.

* * * * *